United States Patent [19]

Knight

[11] Patent Number: 4,709,524

[45] Date of Patent: Dec. 1, 1987

[54] PRESSURE SLIP EXPANSION JOINT

[76] Inventor: Joseph L. Knight, Box 167, Shippenville, Pa. 16254

[21] Appl. No.: 900,393

[22] Filed: Aug. 26, 1986

[51] Int. Cl.[4] ..... E04D 1/00

[52] U.S. Cl. ..... 52/536; 52/554; 52/588

[58] Field of Search ..... 52/536, 538, 542, 554, 52/588, 233

[56] References Cited

U.S. PATENT DOCUMENTS

| | | | |
|---|---|---|---|
| 3,085,367 | 4/1963 | De Ridder | 52/538 |
| 3,188,774 | 6/1965 | McCorkle | 52/536 |
| 3,546,845 | 12/1970 | Kempel | 52/588 |
| 3,935,682 | 2/1976 | Simpson | 52/536 |
| 4,099,358 | 7/1978 | Compaan | 52/588 |
| 4,134,244 | 1/1979 | Sjöander | 52/536 |
| 4,211,047 | 7/1980 | Briggs | 52/588 |
| 4,433,519 | 2/1984 | Jenkins | 52/233 |
| 4,580,373 | 4/1986 | Bastiansen | 52/538 |

FOREIGN PATENT DOCUMENTS

| | | | |
|---|---|---|---|
| 1122226 | 1/1962 | Fed. Rep. of Germany | 52/588 |
| 1900766 | 11/1969 | Fed. Rep. of Germany | 52/588 |
| 1181280 | 6/1959 | France | 52/536 |
| 2383345 | 10/1978 | France | 52/588 |

*Primary Examiner*—Henry E. Raduazo

*Attorney, Agent, or Firm*—Anthony A. O'Brien

[57] ABSTRACT

Building components include, along opposite edges, opposed pairs of non-planar flanges respectively defining male and female attachment members. Provided on the components are opposite underlying and overlying sections with the male attachment members affixed to the front face of the underlying sections, and the female attachment members affixed to the rear face of the overlying sections. A guide element may extend from the female flanges to facilitate camming of paired female flanges about the male flanges of an adjacent component to insure a snap-fitting assembly of a plurality of components.

8 Claims, 7 Drawing Figures

PRESSURE SLIP EXPANSION JOINT

BACKGROUND OF THE INVENTION

The present invention relates generally to a joint construction and more particularly to a pressure slip expansion joint as may be applied to a wide variety of building components such as panelling, siding, tiles, trim members, moldings, door frames, window frames and sashes.

Known examples of construction joints will be found in U.S. Pat. Nos. 2,681,716 and 4,527,369. In the former patent, trim members of deflectible material and having opposite semicircular flanges, are snap-fiited about relatively massive stationary base members by the forceful application of the trim flanges against respective beads on the base member. In the latter patent, construction members are snap-fitted together by means of a separate fastener component initially affixed intermediate the two construction members.

SUMMARY OF THE INVENTION

By the present invention, improved building components are provided, and wherein unique cooperating male and female attachment means are included to insure an enhanced installation or assembly of a plurality of the building components, usually laterally adjacent one another and upon a ceiling, interior or exterior wall of a building. In one form of the invention, each building component may carry, at respective opposite edges, male and female attachment means whereby a plurality of such building components may be adjacently assembled upon a building wall or the equivalent, frequently in an overlapping manner, without the necessity of utilizing any separate, additional connecting element between each pair of building components. Additionally, one of the elements of each pair of cooperating attachment means, may be provided with distinctive, integral guide means to facilitate the assembly of each building component with respect to a cooperating underlying attachment means. A further feature includes the provision of integral anchor means carried by one of the attachment elements to resist separation of an assembled building component such as during high wind gusts, in the case of external siding.

Accordingly, one of the objects of the present invention is to construct a building component having attachment means thereon including pairs of laterally opposed flanges of resilient composition.

Another object of the present invention is to provide an improved building component with a pressure slip expansion joint including an opposed pair of deflectible flanges carried by two opposite edges of the building component, with respective pairs of these flanges serving as male and female attachment means adapted to engage similar pairs of flanges carried by adjacent ones of like building components.

Still another object of the present invention is to provide an improved building component having a pressure slip expansion joint including an opposed pair of deflectible arcuate flanges each adapted to cooperate with an arcuate flange on another building component, and wherein the first-mentioned arcuate flanges include angularly directed guide elements to facilitate joining of the two components as the first-mentioned arcuate flanges are biased about the second-mentioned flanges during assembly of the components.

A further object of the present invention is to provide an improved building component having a pressure slip expansion joint including a pair of deflectible arcuate flanges on one building component adapted to resiliently engage cooperating flanges on another component, with a catch element on at least one resilient flange engageable with an anchor member fixed relative the building construction to resist separation of the attached building component.

With these and other objects in view which will more readily appear as the nature of the invention is better understood, the invention consists in the novel construction combination and arrangement of parts hereinafter more fully described, illustrated and claimed, with reference being made to the attached drawings.

DESCRIPTION OF THE PREFERRED EMBODIMENTS

Figure 1:
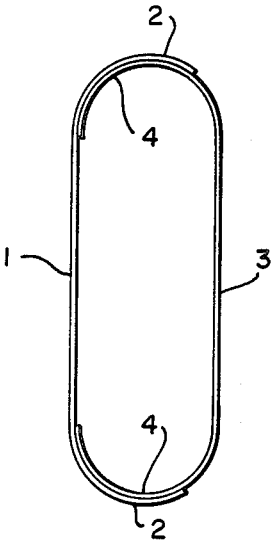
FIG. 1 PRIOR ART
FIG. 1 is an end elevation of a snap-fitting building component according to the prior art.

Referring now to the drawings, FIG. 1 illustrates a known type of snap-fitting building component wherein a trim member 1 having opposite edge flanges of arcuate configuration is adapted to be snap-fitted about a base member 3 likewise having opposite, arcuate edge flanges 4—4. In this example, the outer member 1 may comprise a base molding or other trim member, usually of relatively small vertical height. The present invention improves upon the foregoing general concept by employing separate pairs of spaced apart arcuate flanges adjacent opposite edges of individual building components to allow assembly of panels or siding as shown in FIGS. 2–5 without the necessity of any preliminary preparation of the building wall, or use of supplemental attachment elements. Additionally, guide means is provided in the form of an integral element on at least one of the component flanges to substantially facilitate the snap-fitting action as the building components are installed.

Figure 2:
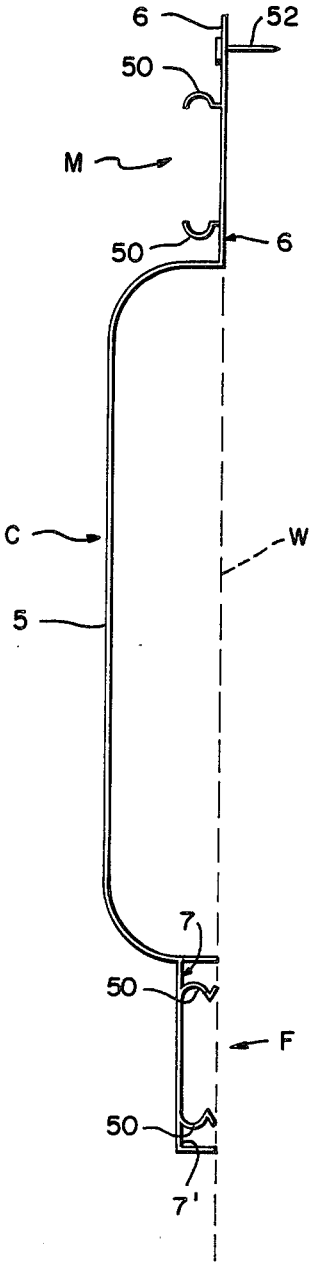
FIG. 2 is an end elevation of a building component including a pressure slip expansion joint according to the present invention.

FIGS. 2–5 of the drawings disclose various building components C, C1, C2 and C3 each utilizing the present attachment concept but offering components exhibiting different exposed outer surfaces to satisfy different uses as will be explained. In FIG. 2, the component C includes a central main section 5 bounded by an uppermost, underlying section 6 and a lowermost, overlying section 7. The opposite edge sections 6–7 are preferably planar, and are disposed in laterally offset planes for reasons which will become obvious hereinafter. The central main section 5 may project laterally from the vertical plane of the lowermost, overlying section 7 any desired amount according to the intentions of the specific component. In the case of the component C, the main section will be seen to be configured to represent the outer portion of a log such that when a plurality of the components C are assembled in adjacent relationship with one section 7 overlapping the section 6 of an adjacent component, a log cabin effect will be produced.

Figure 3:
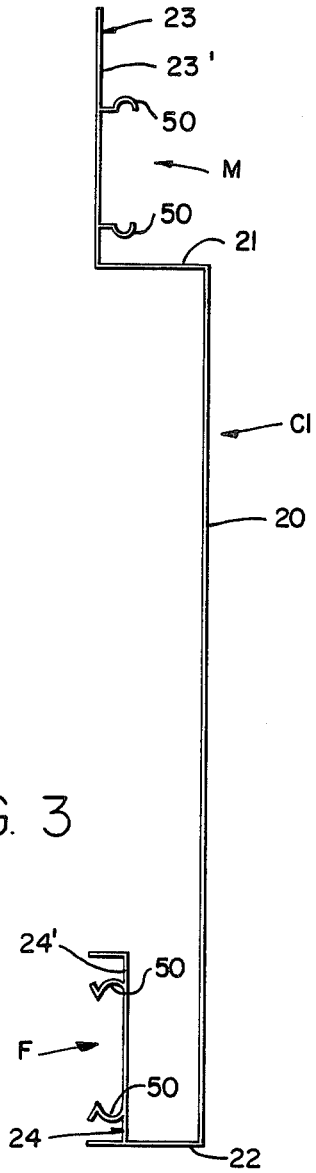
FIG. 3 is a view similar to FIG. 2, and illustrates an alternative embodiment.

The component C1 of FIG. 3 represents a typical configuration such as would be applicable for vertically installed interior panelling, and wherein the main section 20 is planar with its opposite edges leading to respective normal edge walls 21, 22. In this case the edge wall 21 is in turn joined to the underlying section 23, while the opposite edge wall 22 connects with the overlying section 24. When a plurality of these components are assembled with the section 24 of one component overlapping the section 23 of an adjacent component, it will be understood that all edge walls 21–22 will abut such that a continuous flush surface will be formed by a plurality of the component main sections 20.

Figure 4:
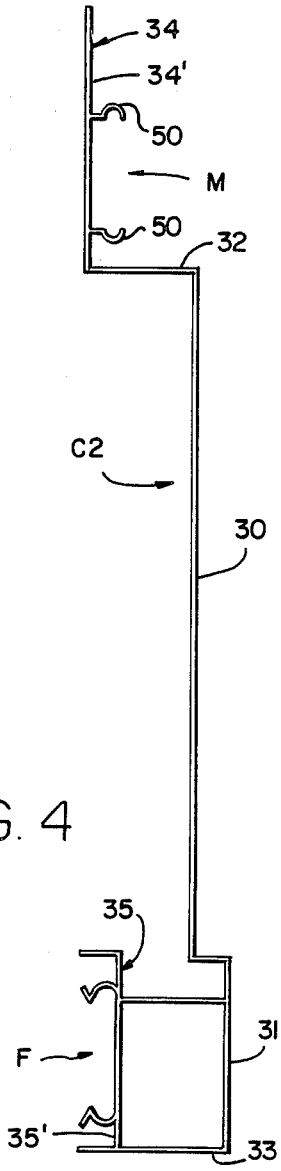
FIG. 4 is a view similar to FIG. 2, illustrating still another embodiment.

FIG. 4 illustrates a building component C2 wherein the main section 30 comprises a planar surface joined at one edge thereof to a relatively narrow raised surface 31 intended to represent a batten, such that the entire component C2 provides a board and batten style vertical siding. Edge walls 32 and 33, normal to the main section 30, in turn connect with the underlying sections 34 and 35, with assembly of a plurality of these components being accomplished in the same manner as with component C1.

Figure 5:
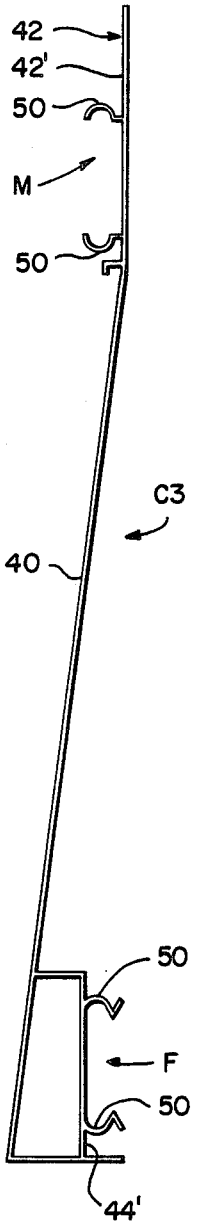
FIG. 5 is a view similar to FIG. 2, illustrating still a further embodiment.

The embodiment C3 of FIG. 5 represents a lap siding component with a main section 40 comprising a planar surface inclined downwardly and outwardly from the edge wall 41 connected to the underlying section 42 to the edge wall 43 which is joined to the overlying section 44. Assembly of a plurality of these components also results in abutment of adjacent normal walls 41, 43 to preclude any gap between the exposed portion of adjacent components.

Throughout the above embodiments of FIGS. 2–4, it will be seen that the underlying section 6, 23 and 34 are all disposed in a plane which is offset from the central main section 5, 20, 30 a distance which is greater than that of the plane of the overlying sections 7, 24, 35. In the case of the lap siding component C3 of FIG. 5, the two edge sections 42 and 44 are illustrated in the same plane, although when a plurality of these components C3 are adjacently assembled, it will be understood that the lowermost overlying section 44 will likewise be disposed in a plane offset to that of the uppermost underlying section 42.

Attached to and projecting from the rear face 7', 24', 35', 44' of each overlying section is a female attachment member generally designated F, while a male attachment member M is affixed to and projects forwardly from the front face 6', 23', 34', 42' of each underlying section. Each attachment member F and M includes a pair of spaced-apart edge flanges 50—50 each defining a non-planar configuration, preferably a substantially semi-circular configuration as shown in the drawings. The respective flanges 50 may comprise individual elements affixed to the front or rear face of the component sections or alternatively, each male and female attachment member may comprise a unitary "C" shaped element having a pair of opposed arcuate edge flanges. A distinction existing between the male and female attachment members M and F is that the dimension between the opposed pairs of edge flanges 50—50 is slightly smaller in the case of the male attachment members M in order to permit snap-fitting of the members M within cooperating female members F when a plurality of the components are assembled. With this in mind it will also follow that the free edges 51 of the female edge flanges 50—50 may describe an arc substantially smaller than that of the edge flanges 50 of the male members F. This is to insure the ability of the free edges 51 of the female member flanges to engage and be cammed about the outer periphery of a pair of male member flanges 50—50. By the same token, the free edge 51 of the female edge flanges should describe a large enough arc to sufficiently pass around and beyond the outermost extent of the arc defined by the male edge flanges, so as to provide the desired snap action and subsequent retention of two thusly assembled building components. To accomplish the foregoing, it has been found that the arc described by the female edge flanges 50 should be at least 100 degrees, that is, as described from the rear face 7' of the overlying section to the free edge 51 of the flange.

With the above in mind, it will be seen that a plurality of the components C, C1, C2 or C3 may be respectively assembled in adjacent relationship, either horizontally or vertically, by engaging the female attachment member F of one component in an overlying manner with the male attachment member M of a previously installed component. The present invention insures a firm interlocking or assembly of a plurality of building components in a snap-fitting manner. Quite obviously additional means will be employed to secure these components with respect to cooperating building structure such as ceiling structure, interior or exterior walls W. This additional fastening means may include nails or screws 52 such as shown in FIG. 2 of the drawings, and which are applied through each underlying section 6 prior to the subsequent attachment of the next adjacent component C.

With the above in mind, it will be appreciated that the component sections 6 and 7 for example, should be planar. In the case of each underlying section, such planar configuration assures a solid installation as this section is mounted upon a wall or furring strip and secured by fasteners 52. Since the overlying sections of other like components are fitted over previously installed underlying sections, it follows that the overlying sections should likewise be planar to properly align the cooperating male and female attachment members M and F.

Although the male members M are shown affixed to the underlying sections 6, 23, 34 and 42, and the female members F affixed to the overlying sections 7, 24, 35 and 44, it will be obvious that the disposition of the attachment members may be reversed from the preferred illustrated locations.

Figure 6:
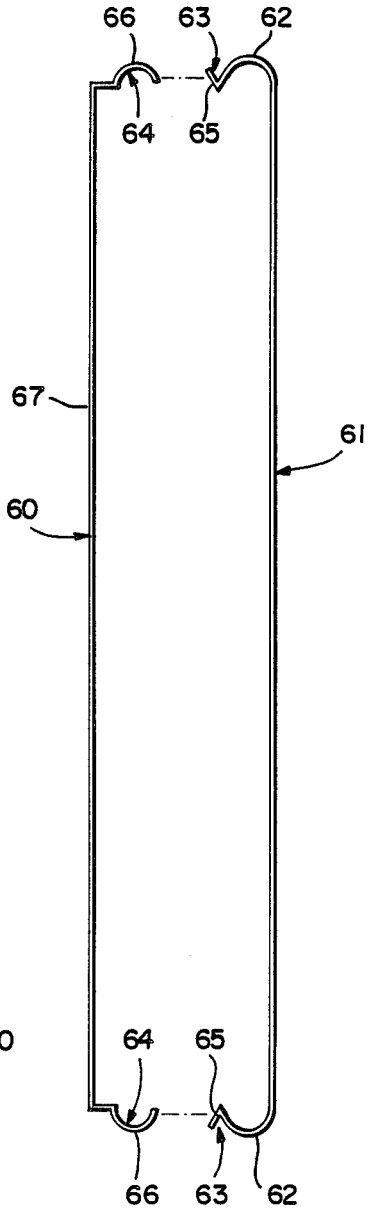
FIG. 6 is an exploded end elevation illustrating a further feature applicable to the attachment members of the present invention.

FIG. 6 illustrates an alternative male and female attachment member which may be substituted for the previously described attachment members M and F. In this latter embodiment, the free edges of the female edge flanges 62 are provided with a guide element 63 comprising an outwardly and angularly displaced arm. With this arrangement, assembly of any component with a previously assembled component is greatly facilitated as there is no exposed, sometimes sharp edges on the female flanges 62 which may bind with or gouge the edge flanges 64 of the cooperating male attachment member 60. The inner face 65 of the guide elements 63 will be understood to engage the outer surface 66 of the cooperating edge flanges 64 of the male member 60 at a very flat angle, almost tangentially such that the female edge flanges 62—62 are automatically biased outwardly to encourage the snap-fitting of the two attachment members 60, 61. The male attachment member 60 is modified to reposition its edge flanges 64—64 spaced from the plane of its base 67 in order to provide clearance for acceptance of the female attachment member guide elements 63 when the two attachment members are joined. It will be understood that the aforementioned base 67 of the male member 60 may comprise the underlying section of any associated building component or alternatively, as previously described, each attachment member 60, 61 may be formed as a unitary element adapted to be affixed to underlying and overlying sections of a building component.

Figure 7:
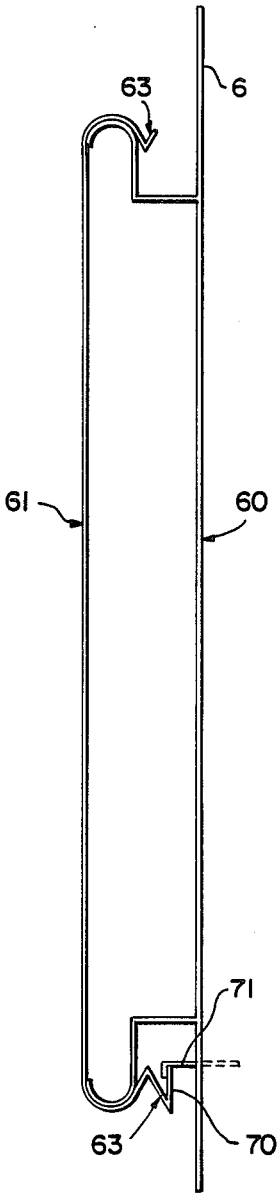
FIG. 7 is an end elevation illustrating the structure of FIG. 6 as it appears when assembled, together with catch means discouraging separation of the assembly.

FIG. 7 depicts the arrangement of FIG. 6 as it would appear when in the assembled condition. Also shown is the provision of positive means to resist separation of the connection shown in FIG. 7 and which may be included, for example, with exterior siding, to resist separation of the components when subjected to high wind gusts. During the assembly of the attachment member 61 to the attachment member 60, an inwardly directed catch element 70 attached to the end of at least one of the guide elements 63 engages behind a suitable stationary anchor member 71, the latter of which has been driven through the component containing the male attachment member 60 and preferably into the underlying building construction. Of course, the guide element 63 may also be used with the construction shown in FIGS. 2, 3, 4 and 5.

From the foregoing, it will be appreciated that the pressure slip expansion joint may be utilized for a wide variety of building components including moldings, door frames, window frames and sashes, which joint offers a positive retention of the opposite edge portions of a plurality of serially connected components. This interfitting attachment is facilitated by integral guide means. Furthermore, this guide means may include a catch element to resist unwanted disassembly of thusly installed building components.

Inasmuch as the preferred embodiments are subject to many modifications, changes in details, and reversal of parts, it is intended that all matter contained in the foregoing description or shown in the accompanying drawings shall be interpreted as illustrative and not in a limiting sense.

I claim:

1. A building component includes a central main section from which extend opposite underlying and overlying sections each having a rear face and a front face, wherein said underlying and overlying sections are planar and disposed in laterally offset parallel planes, a pair of mating attachment members respectively on said underlying section and overlying section, wherein said attachment member on said underlying section is affixed to said front face thereof and said attachment member on said overlying member is affixed to said rear face thereof, said attachment members each including a pair of opposed non-planar flanges projecting respectively from said underlying and overlying sections, said flanges of each said pair of flanges define an arcuate configuration and being configured and spaced from each other to provide a snap-fitting attachment upon joining one said attachment member of one said building component with another one said attachment member of an adjacent like building component.

2. A building component according to claim 1 wherein said attachment members comprise male and female attachment members with said flanges of said male member spaced from one another a lesser distance than said flanges of said female member.

3. A building component according to claim 2 including guide elements projecting forwardly and outwardly from said female attachment member flanges and adapted to deflect said female flanges upon striking said male attachment member flanges on joining of two said building components.

4. A building component according to claim 3 including a catch element on at least one said guide element adapted to engage stationary anchor means upon joining of said building component with a like building component.

5. A building component according to claim 3 wherein said flanges define an arcuate configuration, said flanges of said female attachment member describing on arc less than that of said male attachment member flanges.

6. A building component according to claim 1 wherein said main section is configured to represent the outer face of a log.

7. A building component according to claim 1 wherein said main section is configured to represent the outer face of board and batten panelling.

8. A building component according to claim 1 wherein said main section is configured to represent the outer face of lap siding.

* * * * *